United States Patent [19]

Schippers et al.

[11] Patent Number: 4,720,806

[45] Date of Patent: Jan. 19, 1988

[54] METHOD AND APPARAUS FOR CENTRALLY COLLECTING MEASURED VALUES

[75] Inventors: Heinz Schippers; Gerhard Martens, both of Remscheid; Karl-Werner Frolich, Wuppertal-Langerfeld, all of Fed. Rep. of Germany

[73] Assignee: Barmag AG, Remscheid, Fed. Rep. of Germany

[21] Appl. No.: 717,667

[22] Filed: Mar. 29, 1985

[30] Foreign Application Priority Data

| | | | |
|---|---|---|---|
| Mar. 31, 1984 | [DE] | Fed. Rep. of Germany | 3412115 |
| May 30, 1984 | [DE] | Fed. Rep. of Germany | 3420163 |
| Aug. 17, 1984 | [DE] | Fed. Rep. of Germany | 3430223 |
| Mar. 1, 1985 | [DE] | Fed. Rep. of Germany | 3507178 |

[51] Int. Cl.[4] ..... G06G 7/48

[52] U.S. Cl. ..... 364/551; 340/511; 364/571

[58] Field of Search ..... 364/550, 551, 571, 578, 364/579, 580; 340/506, 509, 511, 516, 518, 521; 73/863.01, 863.31

[56] References Cited

U.S. PATENT DOCUMENTS

| | | | |
|---|---|---|---|
| 3,440,537 | 4/1969 | Warner et al. | 324/99 |
| 4,251,769 | 2/1981 | Ewert et al. | 340/511 X |
| 4,549,168 | 10/1985 | Sieradzki | 340/511 X |
| 4,575,711 | 3/1986 | Suzuki et al. | 340/506 X |
| 4,586,403 | 5/1986 | Lee et al. | 364/571 X |
| 4,589,079 | 5/1986 | Peter | 364/551 |
| 4,589,554 | 5/1986 | Edelbruck et al. | 364/579 X |

FOREIGN PATENT DOCUMENTS

| | | |
|---|---|---|
| 1135384 | 11/1982 | Canada . |
| 1498062 | 11/1965 | Fed. Rep. of Germany . |
| 3142468 | 10/1981 | Fed. Rep. of Germany . |
| 3005746 | 10/1983 | Fed. Rep. of Germany . |

OTHER PUBLICATIONS

Hewlett Packard Catalog, 1984, pp. 90–92.

Industriellen Messtechnik, 1978, pp. 163–174 and 200–229.

Siemens-Zeitschrift, 1971, pp. 812–816.

Feinwerktechnik & Messtechnik, 1977, pp. 863–864 and 1983, p. 115.

*Primary Examiner*—Gary V. Harkcom

*Assistant Examiner*—H. R. Herndon

*Attorney, Agent, or Firm*—Bell, Seltzer, Park & Gibson

[57] ABSTRACT

A method and apparatus to centrally collect measured values of a variable parameter from each of a plurality of work stations, and so as to facilitate quality control. Each work stations includes a sensor for generating an output signal which is a function of the variable parameter, and the output signal is converted to digital signals, which represent discrete increments within the measuring range of the variable parameter. The digital signals are stored during a predetermined period of time in a memory unit so as to be available for periodic scanning by the central computer, after which the stored signals are cleared so that the memory unit is free to record the values during the next period of time. Also, circuitry is provided whereby only the extreme values of the output signalsd ar stored, together with the mean value, which are adequate to provide a complete statement of the quality of the process and product being monitored.

18 Claims, 8 Drawing Figures

METHOD AND APPARAUS FOR CENTRALLY COLLECTING MEASURED VALUES

The present invention relates to a method and apparatus for centrally collecting measured values of a variable parameter from each of a plurality of monitored work stations. The method and apparatus finds particular utility in a yarn textile processing machine which includes a plurality of yarn processing stations.

In German Patent No. 30 05 746, there is disclosed a method wherein the data which is measured in a multi-position textile machine, and which continuously is received from a plurality of monitoring points, is collected and processed by a central data processing system. The ability to scan the monitored points is facilitated in that there are provided several decentralized data processing units positioned between the central data processing system and the monitoring points. Thus, only a limited number of monitoring points are respectively associated to each of the decentralized data processing units. These decentralized data processing units involve the scanning, and the intermediate storage of the data.

With the above-described process, the scanning speed and scanning frequency are increased, but the system is relatively costly and the disadvantage remains that only the momentary values of the measurements are collected at the moment of scanning. In other words, only random values are determined and evaluated, and such random values are unable to provide a reliable indication of the operation of the process and the quality of the resulting product.

It is accordingly an object of the present invention to provide a method and apparatus for continuously monitoring a variable parameter at each of a plurality of work stations, and which more accurately reflects the operation of the process and the quality of the resulting product.

These and other objects and advantages of the present invention are achieved in the embodiments illustrated herein by the provision of a method and apparatus which involves continuously monitoring the value of the variable parameter at each of the work stations, and generating an output signal at each station which is a function of the variable parameter. At least the minimum and maximum values of the output signals which occur during each sequential time interval of predetermined length, are stored. The stored values are then scanned and collected by the central computer control unit. The stored signals are preferably cleared after they have been scanned and collected. By limiting the scanning to the extreme values accumulating over each time interval, a complete statement as to the quality of the process monitored at each of the work stations can be made.

In order to simplify and expedite the evaluation of the output signals, the predetermined range of allowable output signals may be established for each work station, with an error signal being emitted upon exceeding these values.

In a preferred embodiment, the invention also involves the determination of the mean value of the output signal, and the mean value is stored for periodic scanning. The mean value of the output signal has been found to provide a very reliable indication of quality, when considered alone or in combination with the extreme values. For this reason, it is preferred that the extreme values be determined as a variation from the mean value.

If, according to this invention, allowable ranges are determined for the variation of the mean value, as well as for the extreme values, which are determined as a variation from the mean value, it is possible to obtain a reliable, continuous reading of the quality from only three periodically scanned measured values. The mean value may be continuously obtained in a very simple manner, for example, by means of a low pass filter as further described below.

Typically, the output signals are received from monitoring sensors as analog signals. However, in accordance with the present invention, these output signals may be readily converted to digital signals, which result in advantages during the further processing. The conversion from analog to digital signals may be accomplished by dividing the measuring range into discrete increments, and providing for a digital signal to be produced when each increment is reached or exceeded by the analog output signal received from the measuring sensor. These accumulated digital signals are then scanned and collected by the central data acquisition system at predetermined time intervals.

While the present invention does not provide for the determination of the complete time behavior of the measured variables, the invention does, however, permit the determination of the measured variables which occurred during the scanning period. Thus, the extreme values of the parameters which occurred during the scanning period can be ascertained, and this permits an indication of the development of the values which occurred during the scanning period. By storing and collecting only the extreme values, the quantity of data to be transmitted can be significantly reduced.

It is advantageous that the stored digital signals be cleared after they have been scanned and collected by the central data processing unit. Thereafter, further indications as to the characteristics of the parameters and the quality of the process may be obtained, in that the output signals of several successive scanning periods are evaluated. A very short duration of the scanning periods may be selected, since the output signals are available in digital form. By shortening the scanning periods, the monitoring and evaluation of the extreme values are essentially identical with a continual monitoring and evaluation. Nonetheless, the scanning frequency is less than that which is required by the current methods of continual collection of measured data.

These and other objects and advantages of the present invention will become apparent as the description proceeds, when taken in conjunction with the accompanying drawings, in which FIG. 1 is a graphic representation of a continuous recording of a measured parameter, for example, of the yarn tension of an advancing yarn being processed in a textile machine;

Figure 7:
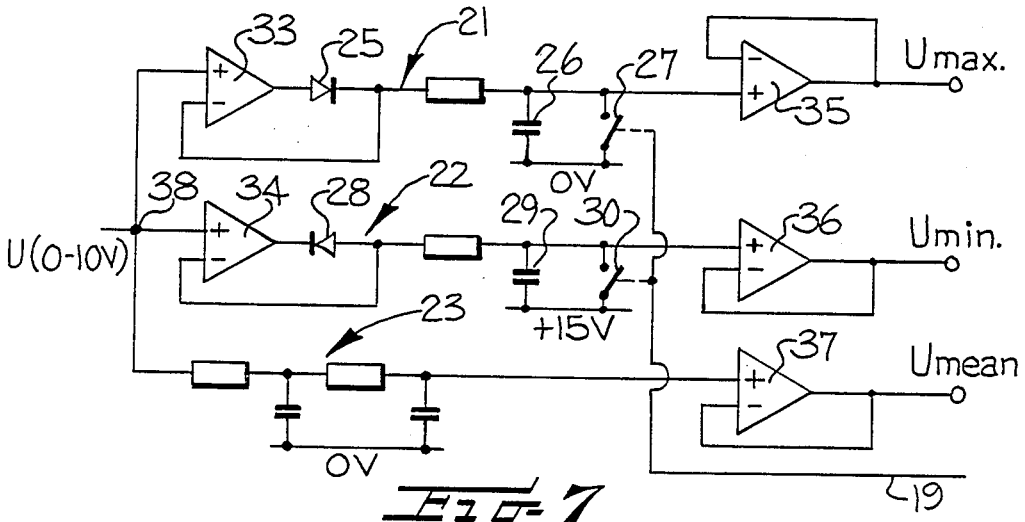
Figure 8:
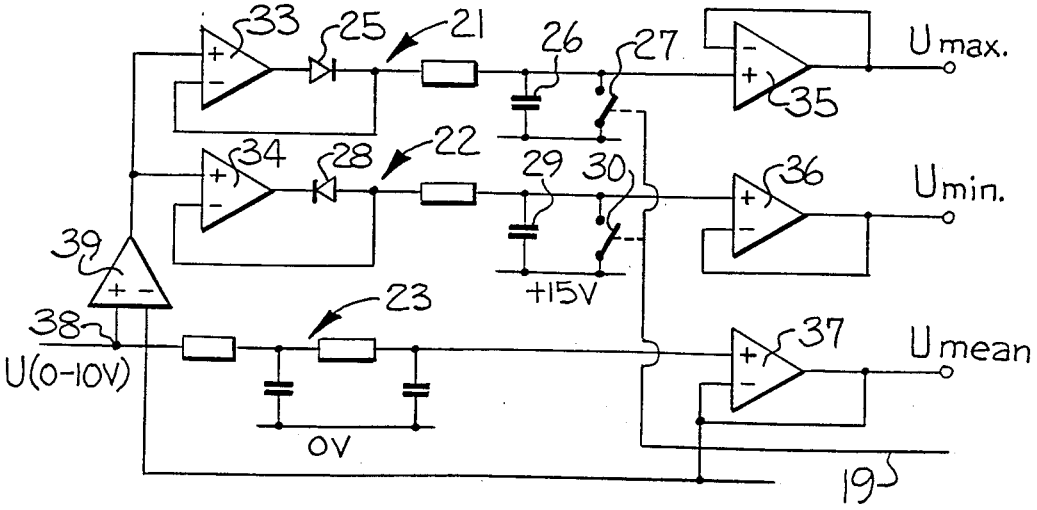

FIG. 7 schematically illustrates a simplified circuit for determining the peak values and the mean value of the input signal; and FIG. 8 illustrates a modified embodiment of the circuit of FIG. 7.

Figure 3:
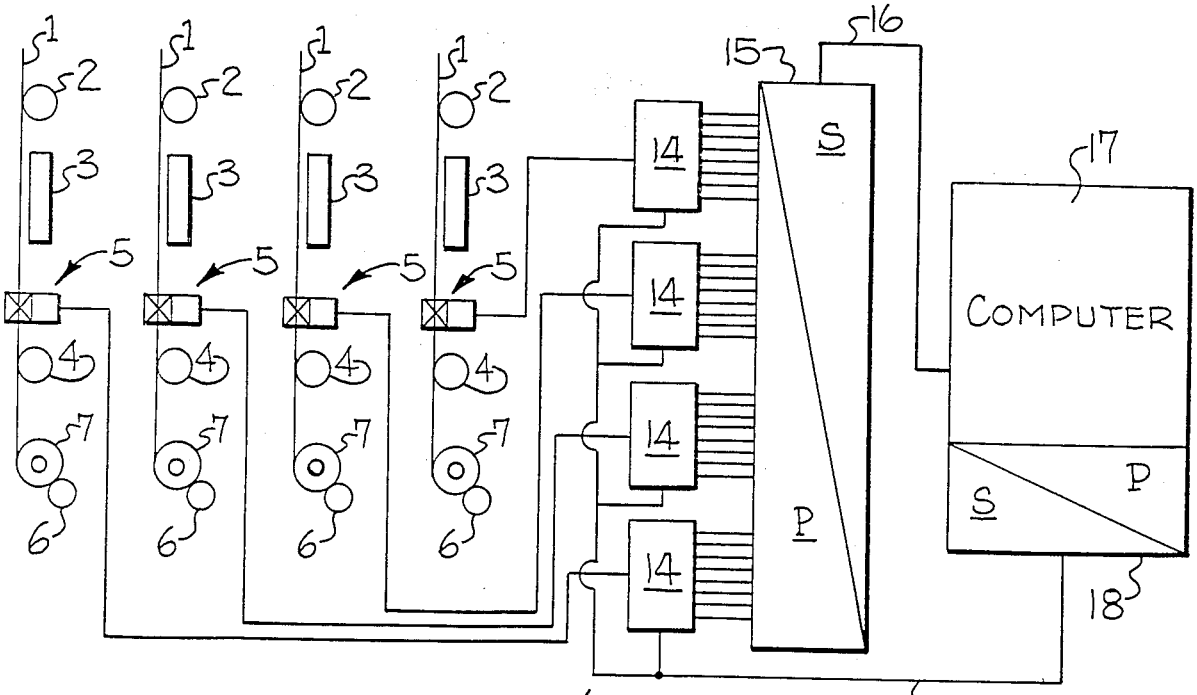
FIG. 3 is a schematic view of four identical yarn processing stations of a multi-position textile machine, and which embodies the present invention.

Referring more particularly to the drawings, there is illustrated in FIG. 3 a multi-position textile machine having four identical yarn processing stations. At each station, a yarn 1 is advanced by a draw roll 2 into a draw zone, where it is guided over a heater 3, and withdrawn by a draw roll 4. A yarn tension meter is indicated at 5, and a take-up system is provided wherein each yarn is wound into a package 7 which is rotated by a drive roll 6. Each tension meter 5 comprises a sensor 8, and comparator circuitry 9 as shown in detail in FIG. 4.

The monitored value of the yarn tension is normally held within certain limits without interfering with the process, and ideally, the measured value would be constant. However, fluctuations in the tension, and particularly temporary fluctuations, do occur. Since the output of the sensor 8 is an analog signal which is a function of the measured parameter, it will be understood that the measured parameter can only be continuously collected if it is continuously scanned. However, when a plurality of measuring sensors are involved, which is the case with the above-described textile processing machines, the continual collection and processing would require a large computer, together with expensive wiring and circuitry. For this reason, it is normal practice to scan the measuring sensors serially one after another. Since for each scanning a certain time is required, it necessarily results that a continual collection of the measured value is not possible, and that a certain time is required for the scanning of the measured values, which necessarily also involves the necessary conversion of the analog signal to a digital signal. A sufficiently precise analysis of the measured parameter by short scanning times thus becomes possible only in cases where the number of measuring points connected to the computer is limited. However, in such cases all temporary fluctuations cannot be ascertained, even though such fluctuations may be of technical significance.

Figure 1:
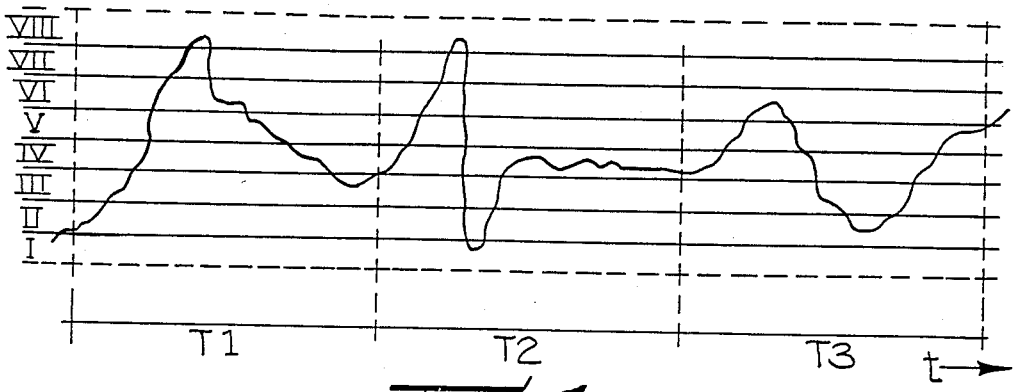

In accordance with the present invention, a certain range of measured parameters which generally occur and are to be collected, is initially determined. This range of measured values is shown in FIG. 1 by the dashed lines, and may be referred to as the measuring range. In the illustrated example, this measuring range is equally divided into eight equal measuring increments, numbered I–VIII.

Figure 2:
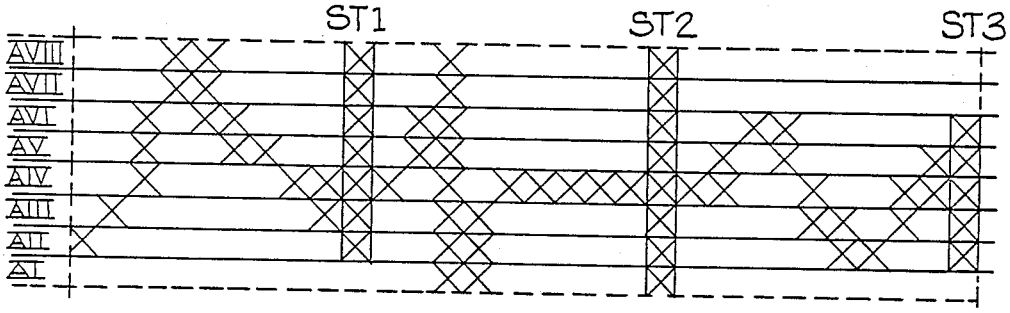
FIG. 2 is a schematic representation showing how the continuous or analog signals of FIG. 1 are converted to digital signals by the present invention.

FIG. 2 illustrates the manner in which the continuously accumulating analog signals are converted to digital signals in accordance with the present invention, and the manner in which these measured values are made available for scanning at predetermined time intervals ST1, ST2, and ST3. As illustrated, a defined digital output signal AI–AVIII, is associated with each interval I–VIII of the measuring range. A digital output signal AI–AVIII is generated, when and as soon as the value of the analog signal from the sensors passes through the associated measuring interval. Further, to the extent they have been generated, the digital output signals AI–AVIII are stored. As a result, the generated digital signals are always ready to be scanned. Within the time interval T1, digital output signals AII–AVIII have been generated and stored, and thus they are ready for scanning at the scanning time ST1. As will also be seen, the measured value widely fluctuated during the scanning period T1, while a greater fluctuation width occurred in the scanning period T2. The fluctuation is substantially less in the scanning period T3.

The values which are stored from each period of time T1, T2, T3, may now be scanned by a central computer at the times ST1, ST2, ST3, and then cleared. It is also provided that there need be no continual collection of the measured values, and that only the extreme values need be collected. The shortening of the scanning times T1, T2, T3 permits an extensive analysis of the measured values, for example, as to periodic fluctuations of the measured values, the time behavior of the range of the measured values, the trend of the extreme values over time, etc. Also, the scanning times T1, T2, T3 may be substantially longer than the scanning times which are required by the prior practices, so as to be able to collect with adequate reliability the extreme values of the analog signals. In addition, the present invention avoids the disadvantage that only random values which occur at the scanning time are received, and the costly intermediate data processing systems of the prior practices are avoided. Further, these prior systems scanned only at certain time intervals and at certain times, and as a result, they were able to collect the extreme values and peak values only randomly, and as a consequence they provided little reliability.

Figure 4:
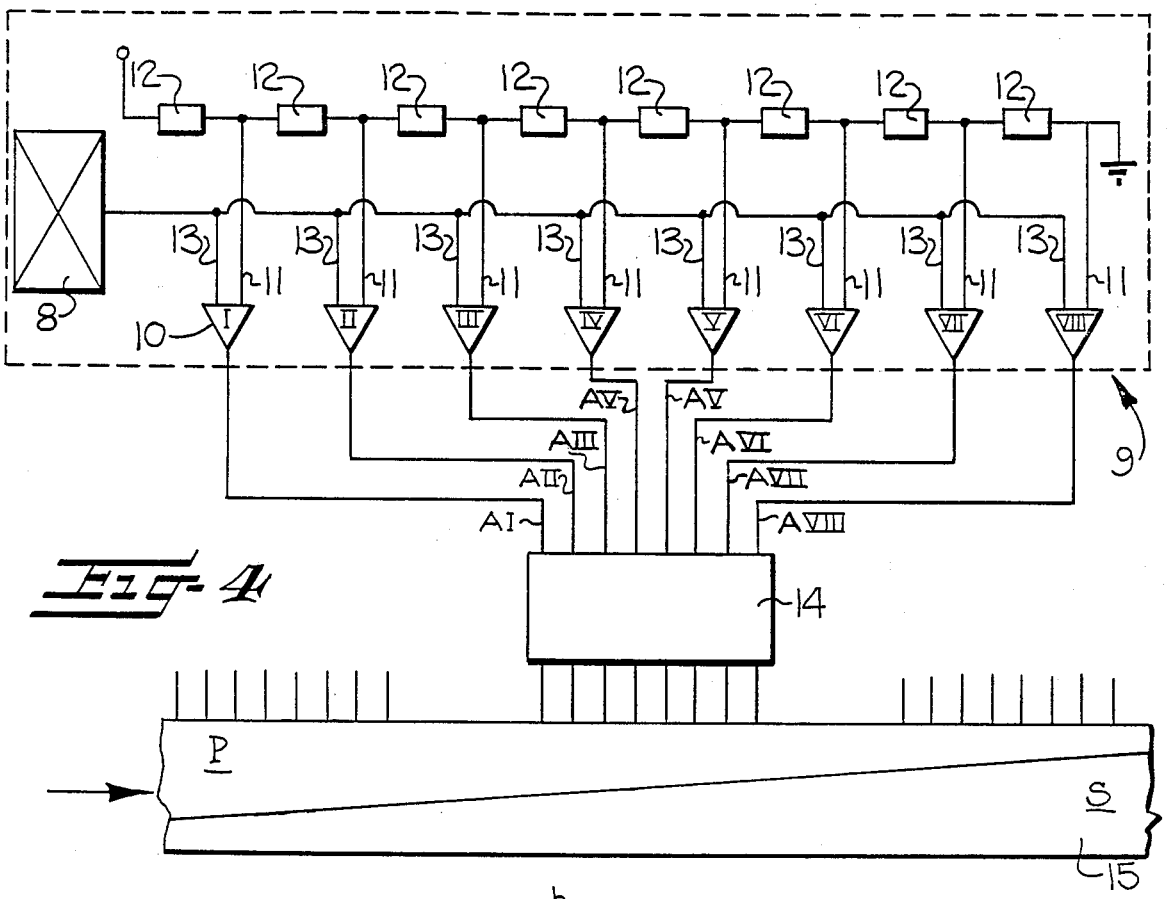
FIG. 4 is a schematic circuit diagram of the comparator circuitry adapted for use with each sensor of the present invention.

For dividing the measuring range into measuring increments, the present invention involves a comparator circuit as illustrated schematically in FIG. 4. By this comparator circuit, each measured value is associated with a predetermined increment, and an output signal is produced when the measured value and the respective value of the comparative signal meet with the comparative criterion, for example, if they are identical.

Each comparator circuit includes eight comparators 10 which are connected via their one input 11 to a series of resistors 12. The second input 13 receives the output signal from the sensor 8. The comparators are so constructed that they emit a digital output signal AI–AVIII, as soon as the value of the input 13 has reached the value of the input line 11. When each resistor 12 is designed so that it respectively represents a measuring increment, each output signal AI–AVIII respectively corresponds to a measuring increment I–VIII. As an alternative, the circuit can also be designed so that the measuring increments slightly overlap. If so, it may be provided that when the measured value is located in the overlapped area of the two increments, the signals of both measuring increments are stored. Preferably however, only the highest value is stored. Accordingly, the comparators may be connected to a logic circuit (not shown), by which each of the output signals AI to AVII is cancelled or cleared, as soon as an output signal of a higher value is generated.

To the extent that the digital output signals AI–AVIII have been generated during a scanning time interval, the signals accumulate in the memory unit 14 and are transmitted to a parallel-series converter 15. The function of the parallel-series converter is to convert the parallel accumulated signals AI–AVIII into a train of impulses which can be supplied to the computer 17 via the line 16. The memory unit 14 also contains the above mentioned logic circuit by which each of the output signals AI to AVII is cancelled, as soon as the output signal of a higher value is generated.

The scanning times ST1–ST3 are predetermined by the computer 17, note FIG. 3, and at each scanning time, the computer delivers a coded train of signals through a connected parallel-series converter 18, to the line 19, by which the memory units 14 are respectively addressed and the stored output signals AI–AVIII are scanned. Once the data has been acquired via line 16, the computer emits via line 19 a clearance signal which is coded for each memory unit, so that the stored output signals are cancelled and thus each memory unit becomes free for the following scanning time period.

It is also preferred in certain embodiments that the entire range of measured values is not collected and evalulated, but rather a limited range of measured values is selected which is representative of an orderly operation. By thus limiting the measuring range, the measured values which are outside of the operating range are eliminated from the beginning from an evaluation, and thus a further simplification is achieved without restricting the reading accuracy. Also, a refined reading accuracy is obtained within the selected limited measuring range, while using the same technical means.

Figure 5:
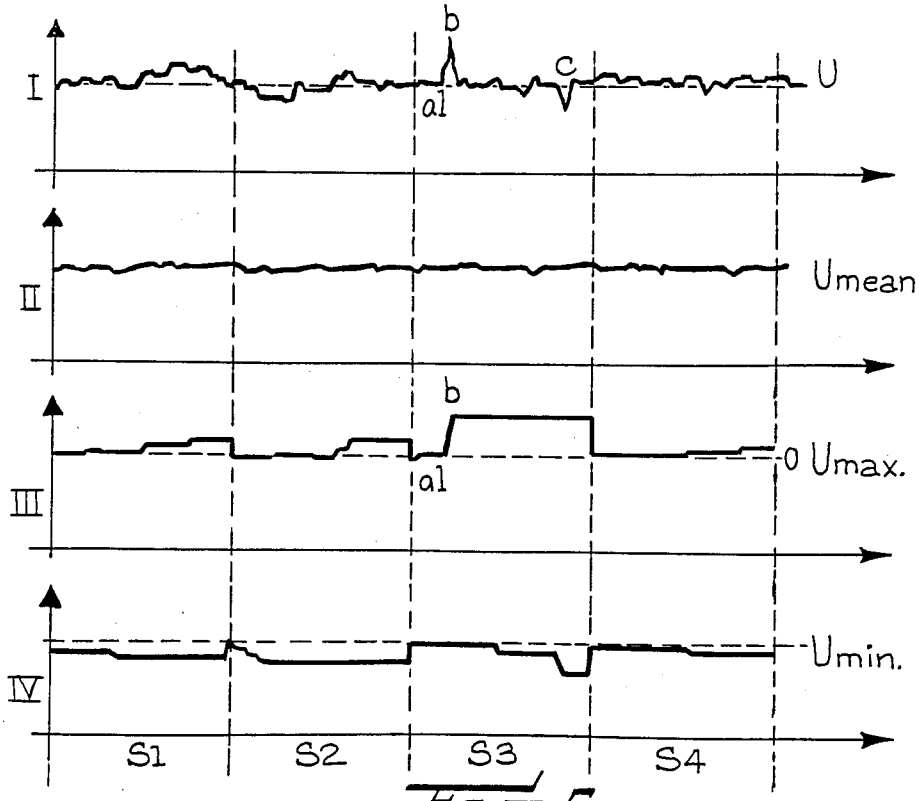
FIG. 5 is a graphic illustration of the measuring method of the present invention, and which involves analog output signals at each measuring point.

FIG. 5 illustrates the measuring system of the present invention, which initially involves an analog output signal from each of a plurality of measuring stations. In all of the illustrated graphs, the abscissa illustrates the time axis, on which a few of the scanning time periods S1–S4 are indicated. The ordinate of graph I shows an example of a possible characteristic of the measured voltage U of a sensor. The measured voltage is a function of and represents the actually occurring value of the parameter being monitored. Graph II has an ordinate which represents the mean value Umean of the measured voltage. According to the invention, this mean value is obtained by passing the measured voltage through a low pass filter as further described below.

Graph III illustrates the formation and scanning of the maximum value Umax over time. Similarly, Graph IV illustrates the formation and scanning of the minimum value Umin of the measured voltage over time. In Graphs III and IV, the measured voltage is respectively related to a reference voltage, for example a zero potential or the mean value. The following examples deal in more detail with the formation and preparation of the extreme values.

Referring for example to the scanning period S3, the measured voltage is initially substantially constant during the period of time (a), and equals the mean value. As a result, the extreme values Umax and Umin equal the mean value during this period of time. In the subsequent period (b), the measured voltage U increases suddenly and temporarily as is shown in Graph I. Since this extreme value is of short duration, the fluctuation has little effect on the mean value. However, the maximum value Umax follows the increase of the measured value to the extreme value, and then holds at this extreme value during the remainder of the scanning period S3 as shown in Graph III. At the end of the scanning period S3, an output signal indicating the extreme value is delivered to the central data processing system, and the value is then cleared so that it returns to the reference value.

During the scanning period S3 and subsequent to the period of time (b), a few negative variations from the mean value occur. In particular, there is a sudden and temporary drop of the measured voltage at (c). As is shown in Graph IV, the storage of the minimum value Umin follows this negative variation of the actually measured value U from the mean value, with the lowest value being stored and kept available for scanning at the end of the period S3. Thus at the end of the scanning period S3, the values of the mean value representing the course of the scanning period, as well as the maximum positive and negative variations thereof are each available for scanning and evaluation by the central data processing system. Alternatively, it is possible to generate the absolute extreme values in addition to the mean value.

Using the above described method and apparatus of the present invention, it is possible to continually determine the yarn tension for each yarn in a textile processing machine having a plurality of working stations, and to make the yarn tension of each yarn available as a maximum, a minimum, and a mean value during each scanning period. Specifically, the central data processing system inquires via a scanner from working position to working position at regular time intervals, and so that the obtained information is available for an analysis as to quality. As a function of the scanned values Umean, Umax, and Umin, error signals may also be produced. For this purpose, a certain predetermined range is established for the mean yarn tension, which is represented by the initial voltage Umean. When the actually determined mean value leaves this range of allowable tensions, an error signal is emitted, and if desired, the affected working position may be shut down. Similarly, a range may be established for the maximum value as a variation from the mean value, and also for the minimum value as a variation from the mean value. These ranges may be different in size.

Figure 6:
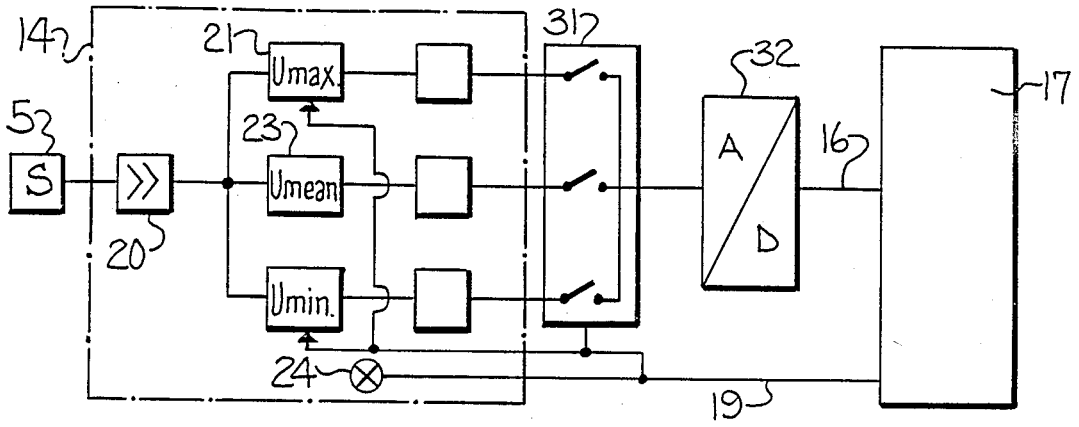
FIG. 6 is a schematic circuit diagram illustrating the conversion of the analog output signal from the monitoring sensor to its peak values, and to its mean value.

FIG. 6 illustrates a basic wiring circuit for the generation of the analog extreme values, and the analog mean value of each measuring point. The measured value, for example the yarn tension of a measuring point, may be continuously determined by a sensor 5 as seen in FIG. 3. A memory unit 14 is associated with each measuring point. The measured values are amplified in the memory unit, and processed to the maximum value Umax, the mean value Umean, and the minimum value Umin, and these values are held ready for scanning. For this purpose, the memory unit contains an amplifier 20 for amplifying the measured signal. A peak value meter 21 is provided for forming the maximum value as a variation from the mean value, and an inverted peak value meter 22 is provided for forming the minimum value as a variation from the mean value. At 23, a low pass filter is indicated which is used to generate the mean value. The other electronic components of the memory unit 14 are conventional, and not indicated.

At the output of the memory unit 14, the maximum value, the continuous mean value, and the minimum value are held ready for scanning. These values are fed to a switch circuit, or scanner 31. The function of the scanner 31 is to sequentially feed the signals which are parallel and simultaneously stored to an analog/digital converter 32, and then via the line 16 to the central processor of the computer 17. As previously indicated, the scanning times are predetermined by the computer 17. At each scanning time, the computer emits via line 19 a coded train of signals for addressing each of the memory units 14 and the scanner 31, whereby the stored values are released to computer 17. Once the data has been received via the line 16, the computer emits a clearance signal via the line 19 which is coded to the individual storages, so that the stored minimum or maximum values are cleared. The mean value remains. Further, an error signaling device 24 such as an alarm (FIG. 6) may also be connected via the line 19.

The peak value meters 21 and 22, and the low pass filter 23 used in the illustrated circuit are conventional. The peak value meters may also be used in the simplified wiring diagram of FIG. 7. In particular, the peak value meter comprises a diode 25 and capacitor 26, with the capacitor being connected to a zero voltage potential. For the measured value U, a voltage between zero to ten is permitted. Since the diode 25 blocks one direction of the current, the capacitor 26 will be charged to the maximum value which is reached during the scanning period, so that this maximum value is stored and remains as an output signal of the scanning period.

A switch is provided at 27, by which the capacitor 26 is discharged. Switch 27 is controlled via the line 19, so that the maximum value may be cleared following the scanning.

The inverted peak value meter 22 includes a diode 28 and a capacitor 29. However, the flow direction is reversed. The capacitor has a reference voltage of 15 volts, which is higher than the maximum measured voltage, which as indicated above is limited to ten volts. As a result, each reduction of the measured value appears on the capacitor 29 as an increased and permanent voltage drop which remains as the minimum value Umin at the output of the storage. At 30, a switch is again indicated, by which the capacitor may be discharged, upon a clearance signal being transmitted via line 19. The low pass filter 23 consists of resistors and capacitors, in a known arrangement.

It will be noted that the circuit of FIG. 7 differs from that of FIG. 6 in that the extreme values are presented by their absolute value. To be in conformity with FIG. 6, it is also possible to process the measured values in memory unit 14 in such a way that the extremes are presented as a difference between the measured extreme values and their average value. For this purpose there exists two alternatives. First, it is possible to insert a means between point 38 and the voltage follower 33, and between point 38 and voltage follower 34, by which the difference is formed between the actual measured value and the average value Umean. Such a differential amplifier is indicated at 39 in FIG. 8. As a second alternative, each of the voltage followers 35 and 36 in FIG. 7 may be replaced by a differential amplifier which is connected to the output of the differential amplifier 37, to thereby process the extreme values Umax and Umin to be presented as the difference between the absolute extreme values and the average value.

In the drawings and specification, there have been set forth preferred embodiments of the invention, and although specific terms are employed, they are used in a generic and descriptive sense only and not for purposes of limitation.

That which is claimed is:

1. A method of centrally collecting measured values of a variable parameter from each of a plurality of monitored work stations, and wherein the parameter is infinitely variable within a given range of variation, and comprising the steps of continuously monitoring the value of the variable parameter at each of the monitored work stations, and generating a continuous output signal at each station which is a function of the value of the variable parameter, storing at least the minimum and maximum values of the output signal from each work station and which occur during each of a sequence of short time intervals of predetermined duration, and scanning and collecting the stored values for each of the work stations at the end of each of said time intervals.

2. The method as defined in claim 1 wherein the stored values are cleared from storage after the scanning and collecting step.

3. The method as defined in claim 2 comprising the further step of limiting the range of the values which are continuously monitored to a range between predetermined limits.

4. The method as defined in claim 3 comprising the further step of generating an error signal upon the monitored value being outside of said predetermined limits.

5. The method as defined in claim 1 comprising the further step of continuously determining the mean value of each output signal, and wherein the mean value is stored and periodically scanned and collected along with the minimum and maximum values.

6. The method as defined in claim 5 comprising the further steps of determining said minimum and maximum values with respect to said mean value, and generating an error signal whenever a maximum allowable variation is exceeded.

7. The method as defined in claim 5 wherein the step of continuously determining the mean value is conducted without reference to the sequence of time intervals.

8. The method as defined in claim 5 wherein the output signal generated at each of the work stations is an electrical signal, and the step of continuously determining the mean value includes passing the electrical signal through a low pass filter.

9. The method as defined in claim 5 comprising the further step of determining said minimum and maximum values as absolute values and without reference to said mean value.

10. The method as defined in claim 1 including determining a range of the output signal for the variable parameter, and dividing the range into discrete increments, and wherein the method includes the step of generating a digital signal whenever the output signal corresponds to a value within one of the discrete increments, and storing such digital signals so as to be available for scanning.

11. The method as defined in claim 10 wherein the step of generating a digital signal whenever the output signal corresponds to a value within one of the discrete, increments includes comparing the output signal with a reference value for each discrete increment, and generating a digital signal whenever the output signal equals the reference value.

12. The method as defined in claim 1 wherein the storing step includes storing only a few selected values of the output signal during each of said time intervals, with the selected values being less in number than all of the values but including the minimum and maximum values.

13. The method as defined in claim 12 wherein the selected values include the mean value of the output signal.

14. An apparatus for centerally collecting measured values of a variable parameter from each of a plurality of monitored work stations, and wherein the parameter is infinitely variable within a given range of variation, and comprising sensor means for continuously monitoring the value of the variable parameter at each of a plurality of work stations, and for generating a continuous output signal at each station which is a function of the value of the variable parameter, means for storing at least the minimum and maximum values of the output signal from each work station and which occur during each of a sequence of short time intervals of predetermined duration, and means for scanning and collecting the stored values for each of the work stations at the end of each of said time intervals.

15. The apparatus as defined in claim 14 further comprising means for continuously determining the mean value of each of the output signals.

16. The apparatus as defined in claim 15 further comprising means for storing the mean value of each of said output signals which occur within each of said time intervals, and wherein said scanning and collecting means includes means for scanning and collecting the stored mean values together with the stored minimum and maximum values.

17. A yarn processing apparatus comprising a plurality of individual yarn processing stations, monitoring sensor means mounted adjacent each of said yarn processing stations for continuously monitoring the value of a parameter of the yarn being processed which is infinitely variable within a given range of variation, and for providing a continuous output signal which is a function of the value of the variable parameter being monitored, means connected to each of said sensor means for storing at least the minimum and maximum values of the output signal from each processing station and which occur during each of a sequence of short time intervals of predetermined duration, and means for scanning and collecting the stored values for each of the processing stations at the end of each of said time intervals.

18. In a yarn processing apparatus as defined in claim 17 further comprising means for continuously determining the mean value of each of the output signals, means for storing the mean value of each of said output signals which occur within each of said time intervals, and wherein said scanning and collecting means includes means for scanning and collecting the stored mean values together with the stored minimum and maximum values.

* * * * *